US010533762B2

(12) United States Patent
Roth et al.

(10) Patent No.: US 10,533,762 B2
(45) Date of Patent: Jan. 14, 2020

(54) METHOD AND APPARATUS FOR CONTROLLING AN HVAC SYSTEM

(71) Applicant: SENSIBO LTD., Tel Aviv (IL)

(72) Inventors: Ran Roth, Tel Aviv (IL); Omer Enbar, Tel Aviv (IL)

(73) Assignee: SENSIBO LTD., Tel Aviv (IL)

( * ) Notice: Subject to any disclaimer, the term of this patent is extended or adjusted under 35 U.S.C. 154(b) by 205 days.

(21) Appl. No.: 14/902,069

(22) PCT Filed: Aug. 11, 2014

(86) PCT No.: PCT/IL2014/050722

§ 371 (c)(1),
(2) Date: Dec. 30, 2015

(87) PCT Pub. No.: WO2015/025315

PCT Pub. Date: Feb. 26, 2015

(65) Prior Publication Data

US 2016/0363336 A1 Dec. 15, 2016

Related U.S. Application Data

(60) Provisional application No. 61/867,073, filed on Aug. 18, 2013, provisional application No. 61/992,933, filed on May 14, 2014.

(51) Int. Cl.
*F24F 11/30* (2018.01)
*F24F 11/62* (2018.01)
(Continued)

(52) U.S. Cl.
CPC ..... *F24F 11/30* (2018.01); *F24F 11/62* (2018.01); *F24F 11/56* (2018.01); *F24F 11/63* (2018.01);
(Continued)

(58) Field of Classification Search
CPC .. F24F 11/006; F24F 11/0012; F24F 11/0015; F24F 2011/0061; F24F 2011/0068; G05B 15/02
(Continued)

(56) References Cited

U.S. PATENT DOCUMENTS 5,495,722 A * 3/1996 Manson ..... G05B 19/0428 62/125
7,489,092 B1 * 2/2009 Larky ..... F04D 27/004 318/34
(Continued)

FOREIGN PATENT DOCUMENTS

CN 101737907 B 10/2011
CN 102022801 B 11/2012
(Continued)

OTHER PUBLICATIONS

Yuan Yanfang, Buzzer Output Control Method and Device (Translation), Sep. 26, 2012, Espacenet, pp. 6-7 (Year: 2012).*
(Continued)

*Primary Examiner* — James J Lee
*Assistant Examiner* — Christopher W Carter
(74) *Attorney, Agent, or Firm* — Tutunjian & Bitetto, P.C.

(57) ABSTRACT

A method and controller for Heating Ventilation or Air-Conditioning (HVAC), the controller having a processing unit and a storage device, the controller comprising: a mapping obtaining module for obtaining a mapping between a pair of a state of an HVAC unit and an action of the HVAC unit and between a measurement; an action determination component for determining an action to be taken by the HVAC unit in accordance with a current state of the HVAC unit; a measurement determination component for obtaining from the mapping a synthesized measurement that when transmitted to the HVAC unit is adapted to cause the HVAC unit to perform the action; and an HVAC communication module for transmitting the synthesized measurement to the HVAC unit.

20 Claims, 3 Drawing Sheets

(51) Int. Cl.
*F24F 110/10* (2018.01)
*F24F 110/20* (2018.01)
*F24F 11/63* (2018.01)
*F24F 11/56* (2018.01)

(52) U.S. Cl.
CPC ..... *F24F 2110/10* (2018.01); *F24F 2110/20* (2018.01)

(58) Field of Classification Search
USPC ..... 700/276
See application file for complete search history.

(56) References Cited

U.S. PATENT DOCUMENTS 8,020,780 B2 * 9/2011 Schultz ..... G05B 19/0425 236/51
9,651,272 B2 * 5/2017 Mori ..... H02J 3/14
2013/0018513 A1 * 1/2013 Metselaar ..... F24F 11/0012 700/278
2014/0148967 A1 * 5/2014 Bayfus ..... D06F 33/00 700/299

FOREIGN PATENT DOCUMENTS

CN 103676704 A * 3/2014
CN 102749945 B 3/2015
WO 98/37364 8/1998
WO 2011/147297 A1 12/2011
WO 2013/058820 A1 4/2013

OTHER PUBLICATIONS

International Search Report dated Dec. 10, 2014 issued in PCT/IL2014/050722.

* cited by examiner

METHOD AND APPARATUS FOR CONTROLLING AN HVAC SYSTEM

CROSS-REFERENCE TO RELATED APPLICATION

This application claims the benefit of U.S. Provisional Application No. 61/867,073 filed Aug. 18, 2013, entitled "A method for seamlessly replacing a control algorithm of an HVAC system using only IR commands", and of U.S. Provisional Application No. 61/992,993 filed May 14, 2014, entitled "A completely external and cable free device and system that connects air conditioners to the internet and uses sensory data to provide superior comfort and energy savings", both of which are hereby incorporated by reference in their entirety.

TECHNICAL FIELD

The present disclosure relates to controlling a Heating, Ventilation, or Air Conditioning (HVAC) system in general, and for replacing a control system of an existing HVAC system, in particular.

BACKGROUND

Heating, Ventilation, or Air Conditioning (HVAC) systems are usually purchased and installed, and then used for many years. Thus, although technology advances and better, more economic and more efficient HVAC systems become available, many older units are still being used, working in suboptimal manner, thus wasting energy and exerting higher cost on their owners.

Some units may be provided with a way to update their control algorithm, but such units are rare, and updating is cumbersome. Otherwise, the control algorithm may only be changed by replacing the whole unit.

Some solutions, such as using a universal remote control, replicate the function of the dedicated remote control of the HVAC unit. However, it is difficult to replace the control algorithm without having direct access to the unit's control parameters such as compressor on/off, fan speed, or the like, or to measurements sensed by the unit, such as temperature. Thus, when cooling, one could set the HVAC target temperature, for example, to 30° C. for stopping the compressor, and to 16° C. for starting it (and vice versa when heating), but this will generally not provide optimal results.

In addition, since the remote control is designed to be used by a user, the HVAC unit usually makes an audible confirmation sound when a command is transmitted to the HVAC unit, in order to provide an indication to the user. Thus, using the remote control commands to replace the control algorithm of the HVAC will cause the generation of such sound for each command, which may annoy the user, particularly when the user is asleep.

There is thus a need for a method and system for replacing the control of an HVAC system, to provide a more pleasant and more energy-efficient behavior, without replacing the whole unit, and without making annoying sounds.

BRIEF SUMMARY

One exemplary embodiment of the disclosed subject matter is a controller having a processing unit and a storage device, comprising: a mapping obtaining module for obtaining a mapping between a pair of a state of an Heating Ventilation or Air-Conditioning (HVAC) unit and an action of the HVAC unit and between a measurement; an action determination component for determining an action to be taken by the HVAC unit in accordance with a current state of the HVAC unit; a measurement determination component for obtaining from the mapping a synthesized measurement that when transmitted to the HVAC unit is adapted to cause the HVAC unit to perform the action; and an HVAC communication module for transmitting the synthesized measurement to the HVAC unit. Within the controller, the HVAC communication module is optionally configured to transmit an iFeel messages to the HVAC unit. Within the controller, the HVAC unit is optionally configured to emit an audible sound when receiving a first type of messages, wherein the HVAC unit is configured to avoid emitting the audible sound when receiving a second type of messages, and wherein the HVAC communication module is configured to transmit the synthesized measurement to the HVAC unit using a message of the second type. Within the controller the synthesized measurement is optionally a temperature measurement. Within the controller, the synthesized measurement is optionally a humidity measurement. Within the controller, the mapping is optionally determined as a reversed mapping of a second mapping, wherein the second mapping maps a pair of a state of the HVAC unit and a measurement to an action. The controller may further comprise one or more sensors, wherein said action determination module is configured to determine the action based on readings from the one or more sensors. Within the controller, the action determination module is optionally configured to determine the action based on a reading that is received from a sensor that is collocated with the HVAC unit. The controller may further comprise an HVAC state monitor configured to monitor an estimated state of the HVAC unit.

Another exemplary embodiment of the disclosed subject matter is a method performed by a computerized device, comprising: obtaining a mapping between a pair of a state of an Heating Ventilation or Air-Conditioning (HVAC) unit and an action of the HVAC unit and between a measurement; determining, by a processor, an action to be taken by the HVAC unit in accordance with a current state of the HVAC unit; obtaining from the mapping a synthesized measurement that when transmitted to the HVAC unit is configured to cause the HVAC unit to perform the action; and transmitting the synthesized measurement to the HVAC unit. Within the method the transmitting optionally comprises sending an iFeel message to the HVAC unit. Within the method, the HVAC unit is optionally configured to emit an audible sound when receiving a first type of messages, wherein the HVAC unit is optionally configured to avoid emitting the audible sound when receiving a second type of messages, and wherein said transmitting optionally comprises transmitting the synthesized measurement to the HVAC unit using a message of the second type. Within the method, the synthesized measurement is optionally a temperature measurement. Within the method, the synthesized measurement is optionally a humidity measurement. Within the method, the mapping is optionally determined as a reversed mapping of a second mapping, wherein the second mapping maps a pair of a state of the HVAC unit and a measurement to an action. Within the method, said determining the action optionally comprises determining the action based on at least one reading by a sensor and based on the current state of the HVAC unit, wherein the sensor is optionally external to the HVAC unit. Within the method, the sensor is optionally collocated with the HVAC unit. The method may further comprise using sensors to monitor the current state of the HVAC unit.

BRIEF DESCRIPTION OF THE SEVERAL VIEWS OF THE DRAWINGS

The present disclosed subject matter will be understood and appreciated more fully from the following detailed description taken in conjunction with the drawings in which corresponding or like numerals or characters indicate corresponding or like components. Unless indicated otherwise, the drawings provide exemplary embodiments or aspects of the disclosure and do not limit the scope of the disclosure. In the drawings.

DETAILED DESCRIPTION

Figure 1:
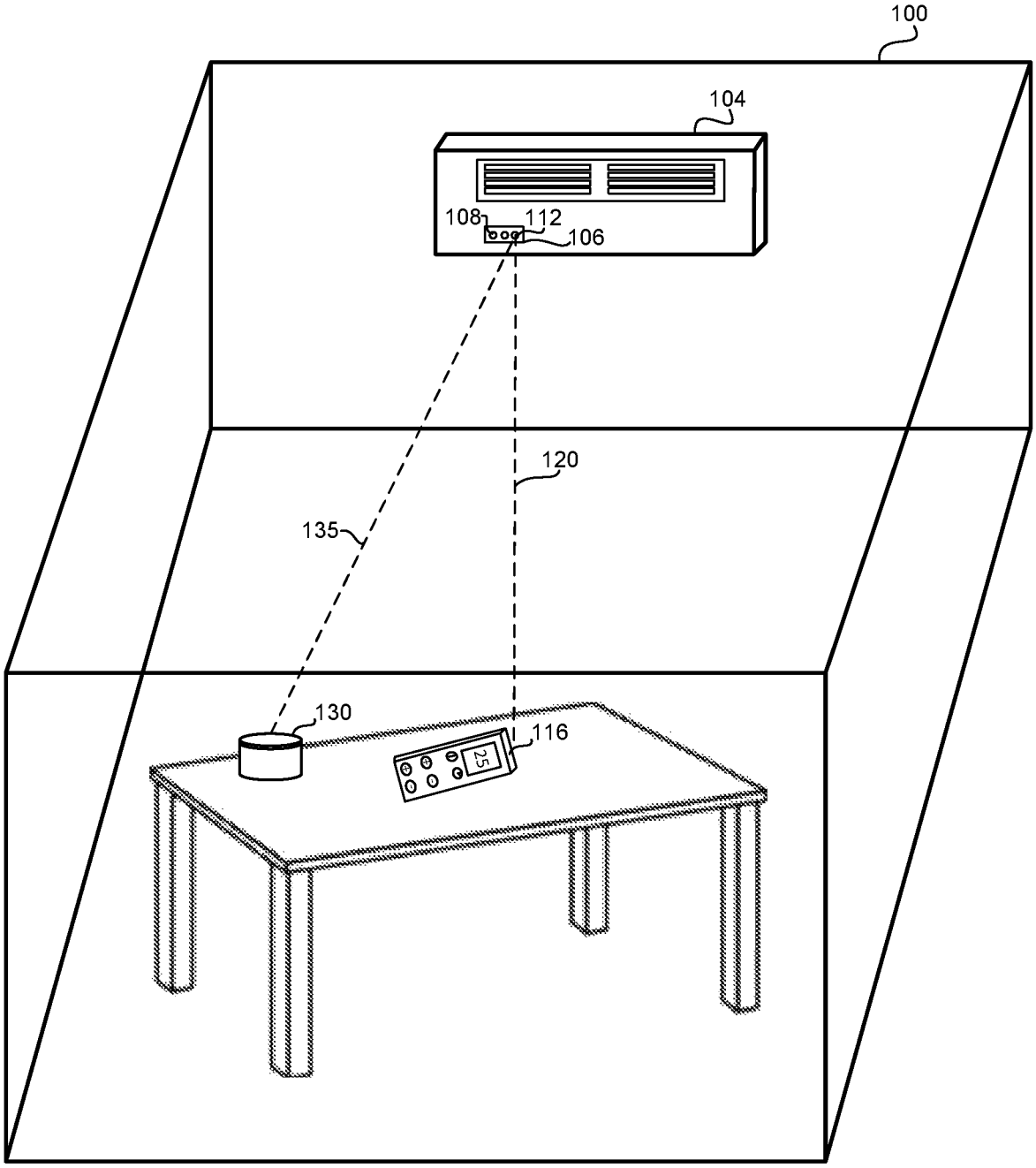
FIG. 1 shows a schematic illustration of an environment with an HVAC unit, in accordance with some exemplary embodiments of the disclosed subject matter.

One technical problem dealt with by the disclosed subject matter is the need to replace the control algorithm and mechanism of HVAC units. In some cases, replacing the control algorithm and mechanism of the HVAC units may enable more energy-efficient control without replacing the whole unit. In some cases, the new control algorithm and mechanism may be configured to control the HVAC unit without causing the HVAC to make audible sounds or other sensory cues that may disturb a person staying in the vicinity of the HVAC unit. In some cases, a smart grid system may decide to change the control of an HVAC unit. Additionally or alternatively, the control algorithm could be personalized to the person currently using the HVAC unit.

Some HVAC units are configured to emit an audible sound (e.g., "beep"), in response to receiving a command, such as via an Infra Red (IR) signal emitted by a remote control. The audible sound may indicate to a user that the command was received and is being processed by the HVAC unit. However, the audible sound and other similar sensory cues may not be desirable when the command that is transmitted is not initiated by a user. In some exemplary embodiments, the HVAC unit may emit some cues which do not interrupt a user, such as modifying a display, turning a LED on or off, or the like.

Many HVAC units have an iFeel feature (also known as "Follow me"). In the present disclosure, an iFeel feature is a feature in which the temperature or another parameter relevant for the operation of the HVAC unit is measured not on the unit itself but at some other location and transmitted to the HVAC unit. In accordance with the disclosed subject matter, the HVAC unit is configured not to emit any audible sound or sensory cue in response to receiving the parameter transmitted as part of the iFeel feature as opposed to other to its operation when receiving other non-iFeel transmissions, such as commands from a remote control.

In some exemplary embodiments, the transmission of the measured parameter may be accompanied by other commands to the HVAC unit, such as change fan speed, change target temperature, or the like. In some exemplary embodiments, the measured parameter may be measured at any location and not by the HVAC unit itself. The location may be fixed or moving. In some exemplary embodiments, a remote control of the HVAC unit may be configured to measure the parameters and wirelessly transmit a command to the HVAC unit. In some exemplary embodiments, the HVAC unit may control its own operation in accordance with its current state, the measurement, and with its control algorithm. The message which is transmitted to the HVAC unit in accordance with the iFeel feature may be referred to as an iFeel message.

One technical solution is to provide a control unit that uses the iFeel feature to transmit simulated, synthesized or "forged" measurements using the iFeel protocol to the HVAC unit, such that the transmitted measurement causes the unit to assume a desired behavior. Thus, it may be that the iFeel message does not reflect an actual measurement by the sensor, but a different measurement that is generated in order to cause the HVAC unit react as required or desired.

Given a specific iFeel message which provides a reported measurement (e.g., reported temperature) and a target (e.g., target temperature), the response of a specific HVAC unit model may be predetermined. For example, sending an iFeel message with a measured temperature of 17° C. while the target temperature is 25° C. degrees may cause the HVAC to automatically stop the compressor's motor (e.g., when in cooling mode). In some cases, the HVAC unit may automatically set the fan speed to low speed in such cases. This operation may be performed without emitting any audible sound or providing other cues that are intended to be sensed by the user, due to using the iFeel feature.

Thus, given a pair (T,S) where T comprises the measurement provided in the iFeel message (e.g., temperature, humidity, or the like), and S is the current state of the HVAC unit which may include the target goal (e.g., target temperature, target humidity, or the like), all units of the same model may be configured to respond with a predetermined behavior, denoted R. In some cases, the predetermined behavior may be determined by a control algorithm and mechanism of the HVAC. The mapping (T, S)→R can be obtained for each model of HVAC units. In some embodiments, the mapping may be provided by a user who may input an observation of the specific unit behavior. The mapping may be provided using a user interface through which the user can select iFeel and target measurements and required behavior, for example, compressor on/off state, fan speed, fan direction, flap movements, or the like.

In an alternative embodiment, the mapping may be a priori provided and retained in a computer readable format. As an example, the mapping may be stored in computer readable file retaining the mapping in any computer readable format. Additionally or alternatively, the mapping may be retained in a data storage In yet another alternative embodiment, the mapping may be obtained by manually or automatically setting the HVAC unit to a particular state S, reporting a measurement T and observing the response R, also referred to as assumed behavior, or change in the behavior.

Once the mapping (T, S)→R is available, a reverse mapping may be determined, such that for each pair S and R, wherein S is the current state and R is the required behavior or behavior change to be assumed, a corresponding T, i.e., the measurement to be reported, may be determined. As an example, if the desired behavior is turn off the compressor and turn the fan speed to low, and the current state of the HVAC unit comprises a target temperature of 25° C. and operation mode is cooling mode, then the mapped measurement may be 17° C. In some exemplary embodiments, the mapping (T, S)→R may not be an injective function. In some cases, there may be several alternative measurements $T_1, T_2, \ldots, T_N$ that when the HVAC is in state S are mapped to the same required behavior R. The reverse mapping may map (S,R) to a single measurement out of the set of alternative measurements.

In some exemplary embodiments, when the control algorithm determines a desired change to be applied to the behavior of the HVAC unit (e.g., turn the motor on/off, put the fan to high/low, change the flaps direction, or otherwise affect the operation of the HVAC unit) it may search in the reverse mapping for a combination of the current state and the required behavior. Once the combination is found, the measurement associated with this combination is retrieved. The combination of the current state and the determined measurement, which may not necessarily reflect an actual measurement, is then transmitted by an iFeel message, such that the HVAC unit indeed assumes the desired behavior, while not generating audible sounds.

In some embodiments, the current state of the HVAC unit is not required to be transmitted by the iFeel message. In these embodiments, only the determined measurement may be transmitted although the temperature determination algorithm may internally keep track and use the state of the HVAC unit.

In alternative embodiments, and if the HVAC unit supports this protocol, the required behavior rather than the measurement may be transmitted to the HVAC unit by an iFeel message and assumed by the HVAC unit. The required behavior may be transmitted from any control unit, such as a unit determining the required behavior or any external unit.

Referring now to FIG. 1, showing a schematic illustration of an environment with an HVAC unit controlled in accordance with some exemplary embodiments of the disclosed subject matter.

FIG. 1 shows a schematic illustration of room 100, in which HVAC unit 104 is installed. HVAC unit 104 may be installed anywhere in the room, including areas which may be inconvenient to access on a daily basis, such as high on a wall. HVAC unit 104 may be connected to a compressor unit (not shown) or another operative unit which is typically installed externally to room 100, such that its operation does not affect the climate of room 100. The compressor unit may be installed in an external location, such as on a roof, on an external wall of a building, in a terrace, or the like.

HVAC unit 104 may comprise a control panel 106 comprising an on/off led 108 and possibly additional displays and controls, such as a temperature display, a timer, temperature controls, or the like. Control panel 106, or any other location of HVAC unit 104 may also comprise a receiver 112, such as an Infrared (IR) receiver, Radio Frequency (RF) receiver, an ultrasonic receiver, or the like. In some exemplary embodiments, control panel 106 may be controlled from a smartphone using WiFi or Bluetooth, or otherwise controlled from the Internet. In some exemplary embodiments, control panel 106 may be controlled from a remote source, such as remote control 116 or remote component 130 (using Commands 135).

HVAC unit 104 may also comprise one or more sensors such as a temperature sensor, a humidity sensor or others.

Remote control 116 may have controls thereon to enable a user to manually submit commands such as start/stop, set the target temperature, set a timer, or the like. Remote control 116 may submit the commands using an IR transmitter, an RF transmitter, or the like. HVAC unit 104 may use readings from the sensors in conjunction with commands 120 from the remote control to determine, for example by a controller thereof, whether and how to operate the unit, for example start/stop the compressor, set fan speed to high/low, set flaps direction, or the like.

HVAC unit 104 may implement an iFeel feature in which the sensor readings are not received from sensors comprised by the unit itself, but rather elsewhere. In some cases, the sensor readings may be readings of sensors comprised by remote control 116, remote component 130, or the like. In this configuration, the sensor readings may be transmitted to HVAC unit 104 using iFeel messages. The iFeel messages may be transmitted using the communication protocol between HVAC unit 104 and remote control 116 used for transmitting commands, or another communication protocol supported by HVAC unit 104. It will be appreciated that the sensors may also be installed in a location other than the remote control, and the readings may be received by the remote control and transmitted to HVAC unit 104.

Typically, commands initiated by a user using remote control 116 cause HVAC unit 104 to emit an audible sound such as "beep", while transmissions of iFeel messages do not cause HVAC unit 104 to initiate the sound.

In accordance with some embodiments of the disclosed subject matter, remote control 116 may use the iFeel mechanism, but instead of transmitting a measurement such as a measured temperature, a controller first determines the required behavior of HVAC unit 104. Remote control 116 may then transmit a determined (rather than measured) reading such as temperature or another sensor reading, which will make HVAC unit 104 assume the required behavior. Additionally or alternatively, remote component 130 may send iFeel messages to control HVAC unit 104. In some cases, remote component 130 may not comprise user interface, such as a keyboard, to allow a user to provide commands to HVAC unit 104. In some cases, remote component 130 may be connected to another device, such as a web server, to receive information useful to determine a desired behavior for HVAC unit 104. In some exemplary embodiments, the user may use an external device, such as a mobile phone, a mobile device, or the like, to send commands to HVAC unit 104 via remote component 130.

In some exemplary embodiments, remote component 130 may comprise one or more sensors. In some exemplary embodiments, remote component 130 may comprise a temperature sensor. Additionally or alternatively, remote component 130 may comprise a humidity sensor. Additionally or alternatively, remote component 130 may comprise a vibrations sensor. The vibrations sensor, such as a piezoelectric disc, may be mounted on the HVAC unit 106 to determine current fan speed of the HVAC unit 106. Additionally or alternatively, remote component 130 may comprise a microphone which may be used to detect sounds that are indicative of a person being located in room 100. The microphone may also be used to detect audible sounds emitted by HVAC unit 106 when HVAC unit 106 receives a command from another source, such as remote control 116 thereby assisting in determining a current state of HVAC unit 106. Additionally or alternatively, remote component 130 may comprise a light sensor which may assist in determining whether a person is in room 100 and detect whether a night mode should be operated. Additionally or alternatively, remote component 130 may comprise a proximity sensor, such as passive infrared detectors, ultrasonic detectors, Bluetooth Low Energy (BLE) proximity sensor, or the like. The proximity sensor may be used to detect whether a person is located in room 100.

Figure 2:
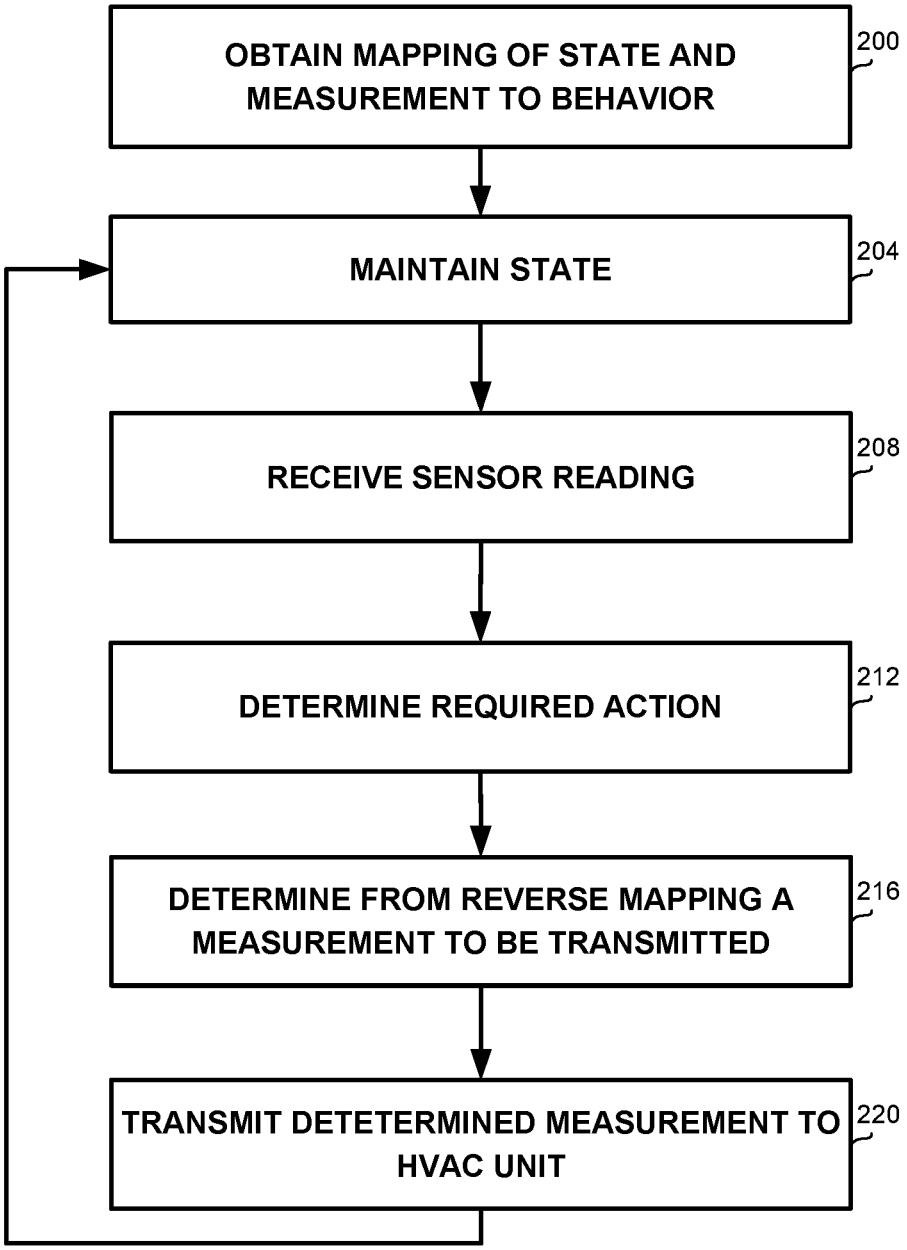
FIG. 2 is a flowchart diagram of a method for controlling the operation of an HVAC unit, in accordance with some exemplary embodiments of the disclosed subject matter.

Referring now to FIG. 2, showing a flowchart diagram of a method for controlling the operation of an HVAC unit, in accordance with some embodiments of the disclosed subject matter. The method may be performed by a control unit external to the HVAC unit, for example a remote control 116 of FIG. 1, remote component 130 of FIG. 1, or the like, such that the control algorithm may be update or enhanced without replacing any component of the HVAC unit itself.

On step 200, a mapping may be obtained from a measurement (e.g., temperature) and a current state of the HVAC unit, which may include a mode of operation, current fan speed, a target temperature, a target humidity, or the like, to a required behavior of the HVAC unit, for example starting or stopping the compressor, causing the compressor to change speed of the compressor motor (e.g. in an inverter A/C), changing fan speed, changing a direction of flaps of the HVAC unit, or the like. The mapping may be denoted (S, T)→R, wherein S is the current state of the unit, T is a measurement or set of measurements, and R is the behavior the unit will assume when in state S and receiving measurement T.

On step 204, the current operation state of the HVAC unit may be maintained, including for example the target temperature or humidity, whether the compressor is on or off, the fan speed or any other operational parameter of the unit.

On step 208, a sensor reading may be received, such as a temperature reading, a humidity reading, or the like. The reading may be received from a sensor located on the HVAC unit, on a remote control, on a remote component or in any other location. In some exemplary embodiments, the readings are received from any sensor other than internal sensors of the HVAC unit.

On step 212 a required action or behavior to be taken by the HVAC unit may be determined upon the received sensor reading and the current state of the HVAC unit. The required behavior may be determined upon any control algorithm, which may be changed occasionally, may be personally adapted to a user of the system, or the like. In some exemplary embodiments, the desired behavior may be determined based on a plurality of inputs, such as but not limited to the sensor reading of step 208, weather information, information available online, historic database of interactions by the user or similar users, current electricity pricing, or the like. In some exemplary embodiments, the required action may be an action determined by a user and provided by a remote control.

On step 216, using the current state of the system and the required behavior, a reverse mapping of the mapping obtained on step 200 may be used to determine a simulated measurement to be transmitted to the HVAC unit.

On step 220 the synthesized measurement is transmitted to the HVAC unit, for example using an iFeel message, to avoid the generation of audible sounds or other cues that may annoy or disrupt a person located in the same room in which the HVAC unit is deployed.

It will be noted that while current solutions transmit the measurement as is, thus causing the HVAC unit to apply the corresponding behavior in the mapping as obtained on step 200, transmitting the proposed measurement determined on step 216 will cause the unit to assume the desired behavior, thus "bypassing" the control algorithm of the HVAC unit.

It will be further noted that in some embodiments, the method may transmit both iFeel messages and non iFeel messages, thereby selectively causing the HVAC unit to emit an audible or other user-notable cue.

Figure 3:
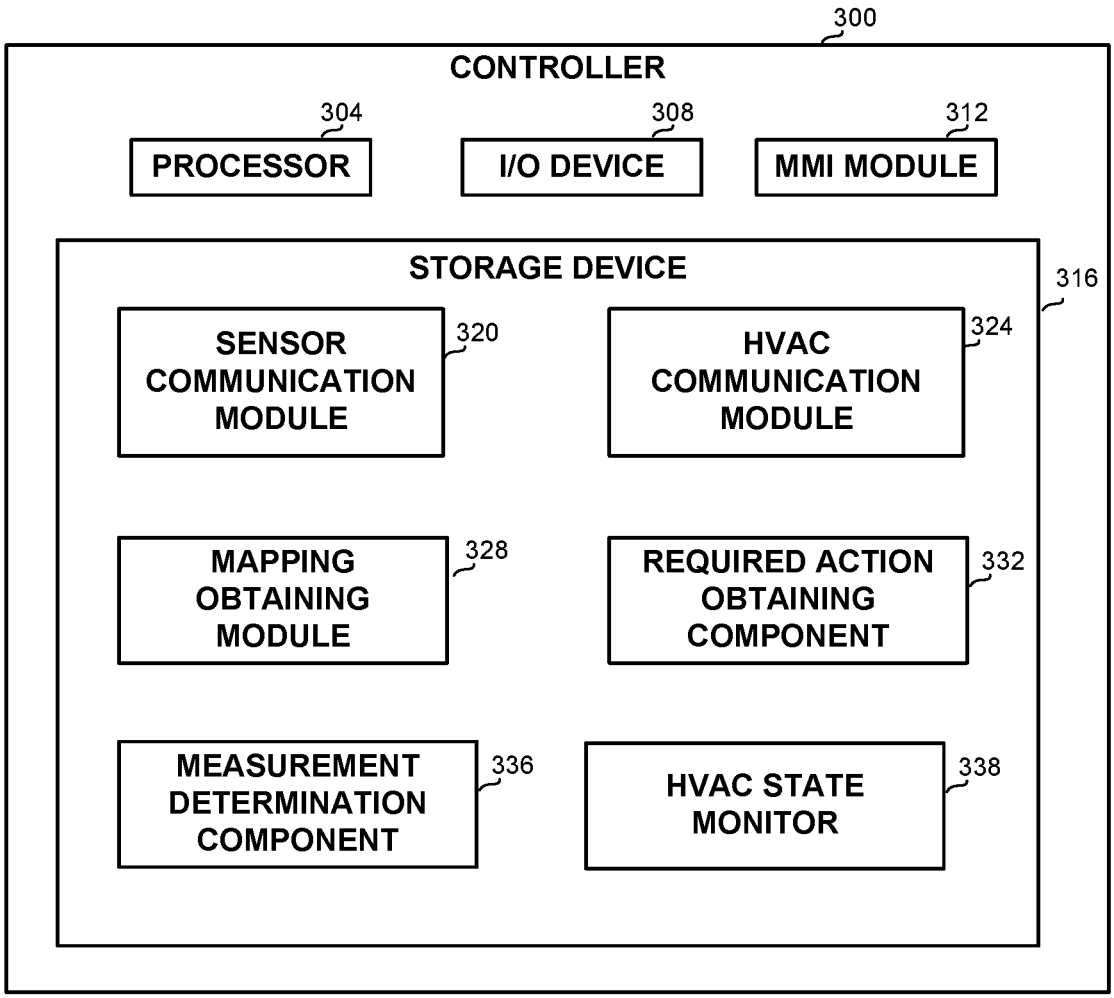
FIG. 3 is a schematic illustration of a controller for controlling the behavior of an HVAC unit, in accordance with some exemplary embodiments of the disclosed subject matter.

Referring now to FIG. 3, showing a schematic illustration of a controller for controlling the behavior of an HVAC unit, in accordance with some exemplary embodiments of the disclosed subject matter.

In some exemplary embodiments, controller 300 may be implemented as part of a remote control for an installed HVAC unit or as an additional component in addition to an existing remote control. In most HVAC systems, a remote control may be replaced, as long as the new remote control may transmit commands to the HVAC unit using the same protocol as the previous remote control.

Controller 300 may comprise one or more processor(s) 304. Processor 304 may be a Central Processing Unit (CPU), a microprocessor, an electronic circuit, an Integrated Circuit (IC) or the like. Processor 304 may be utilized to perform computations required by the Controller 300 or any of it subcomponents.

In some exemplary embodiments of the disclosed subject matter, controller 300 may comprise an Input/Output (I/O) device 308 such as a display, buttons, a pointing device, a keyboard, a touch screen, or the like. I/O device 308 may also comprise a disk drive or may provide communication with a storage device or with a network, from which updated components may be received.

Controller 300 may comprise MMI module 312 which may be utilized to provide output to and receive input from a user using any one or more of I/O device 308.

In some exemplary embodiments, controller 300 may comprise a storage device 316. Storage device 316 may be a hard disk drive, a Flash disk, a Random Access Memory (RAM), a memory chip, or the like. In some exemplary embodiments, storage device 316 may retain program code operative to cause the processor 304 to perform acts associated with any of the subcomponents of controller 300. The components detailed below may be implemented as one or more sets of interrelated computer instructions, executed for example by processor 304 or by another processor. The components may be implemented as assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

Storage device 316 may comprise sensor communication module 320 for communicating and receiving measurements from one or more sensors such as a temperature or humidity sensor. Each such sensor may be co-located on controller 300 or reside at a remote location, for example on the HVAC unit or anywhere else. In some exemplary embodiments, the sensors may be external to the HVAC unit. In some exemplary embodiments, the sensors may be located outside the room or house where the HVAC unit is installed, for example monitoring weather and pollution data outside. The sensors may be mounted on the HVAC unit or otherwise collocated with the HVAC unit. The sensors may be located in the same room as the HVAC unit. In some cases, each sensor may be located in a different location.

Storage device 316 may comprise HVAC communication module 324 for transmitting commands or data to the HVAC unit, for example using an iFeel messages. HVAC communication module 324 may utilize an I/O Device 308, such as an IR transmitter, RF transmitter, or the like. HVAC communication module 324 may transmit commands silently, without causing the HVAC unit to emit audible sounds that are emitted by the HVAC unit intentionally to provide a feedback to the user.

Storage device 316 may comprise mapping obtaining module 328 for obtaining the mapping that is descriptive of an operation of the HVAC unit. The mapping may be a mapping between a pair of a state of the HVAC unit and an action of the HVAC unit to a measurement (e.g., (S, R)→T mapping). The mapping may be a reverse mapping of a (T, S)→R mapping. The mapping may be received, for example through MMI module 312, through a file, obtained by repeatedly transmitting commands and detecting the assumed behavior, from a server, or the like. In some exemplary embodiments, the mapping may be a mapping that is relevant to HVAC units of the same type as a target HVAC unit (e.g., 104 of FIG. 1). In some exemplary embodiments, the obtained mapping may be the (T, S)→R mapping which may be used as a reversed lookup table on demand. Additionally or alternatively, the mapping may be a lookup table depicting the (S, R)→T mapping.

In some exemplary embodiments, the mapping may be detected automatically. A command for an action (S) may be transmitted to the HVAC unit together with a measurement (T). Sensors deployed on or near the HVAC unit may be used to determine response of the HVAC unit (R). As an example, the sensors may detect vibrations indicative of whether a fan of the HVAC unit operates. As another example, a microphone may be used to detect sound indicative of a compressor turning on or off. By sending different pairs of measurements and actions (T,S), the (T,S)→R mapping may be automatically determined and used to determine the (S,R)→T mapping. In some exemplary embodiments, the automatic determination of the mapping may be performed after the controller 300 is installed and with respect to the specific HVAC unit. Additionally or alternatively, the determination may be performed based on another HVAC unit of a similar or same type, and may be determined before the installation of controller 300. In some cases, after controller 300 is deployed it may automatically determine whether a mapping relevant to the HVAC unit is available (e.g., such as by trying a sample of pairs and detecting that the response is as expected, by comparing a make and model of the HVAC unit to those of maps that are available to the controller 300, or the like). If the mapping is available it may be used. Otherwise, the mapping may be determined automatically. The determined mapping may be transmitted to a remote location, such as a server, to be retained so as to be available to other controllers that are deployed to interact with HVAC units of the same make and model.

Storage device 316 may comprise an action obtaining component 332 for determining an action of an HVAC unit given a set of conditions. The set of conditions may include a state of the HVAC unit, readings obtained by sensor communication module 320. In some embodiments, the required action or behavior may be determined in accordance with external decisions. For example, on very hot days wherein the electrical company is nearing its maximal capacity, it may have the option to order certain HVAC units to switch off or assume the most economical mode, for example fan mode, in order to avoid supply failure. In some exemplary embodiments, a smart grid electricity system, which provides real-time monitoring of electricity consumption, may order the HVAC unit to switch off when the grid reaches maximal capacity and turn back on when the consumption is back below a threshold. It will be appreciated that action obtaining component 332 may be replaced over time, as a more suitable operation manner is determined, the requirements of the room occupants change, the room structure and furnishing changes, HVAC units are added or removed, or the like. By updating action obtaining component 332 the control algorithm of the HVAC unit may be modified. Action obtaining component 332 may be updated by downloading a new version from the Internet or from a computerized network, copying an executable file from an external storage device, or the like.

Storage device 316 may comprise measurement determination component 336 for determining a synthesized measurement, such as a temperature, to be transmitted to the HVAC unit. It will be appreciated that measurement determination component 336 may utilize the mapping obtained by mapping obtaining module 328 to determine the synthesized measurement based on the action determined by action obtaining component 332 and based on a current state of the HVAC unit.

Storage device 316 may comprise HVAC state monitor 338 that is configured to monitor the state of the HVAC unit. In some exemplary embodiments, HVAC state monitor 338 may utilize sensor readings to estimate a state of the HVAC unit, such as by monitoring vibrations of the HVAC unit. Additionally or alternatively, HVAC state monitor 338 may utilize an I/O device 308 such as an IR receiver that is located near a corresponding receiver of the HVAC unit to receive commands to the HVAC unit from another source, such as a remote control. In some cases, sensor readings, such as identifying an audible cue emitting by the HVAC unit, may be used to determine whether a command received by controller 300 was also received by the HVAC unit.

The disclosed controller and method provide for controlling an HVAC unit in a replaceable manner, thus replacing the control algorithm of old or inefficient units, without replacing the whole unit, and without generating annoying sounds.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A controller for replacing a dedicated remote control of an Heating Ventilation or Air-Conditioning (HVAC) unit, wherein the controller comprising a processing unit and a storage device, wherein the storage device retaining a mapping between a pair of a state of the HVAC unit and an action of the HVAC unit and between a forged environmental measurement, wherein the HVAC unit is configured to emit an audible operational sound when receiving a first type of messages, wherein the HVAC unit is configured to avoid emitting the audible operational sound when receiving a second type of messages, wherein each message of the second type comprises a reported measurement;

wherein said processing unit is configured to:

obtain a current state of the HVAC unit;

determine an action to be taken by the HVAC unit;

instruct the HVAC unit to perform the action by transmitting, using a wireless transmitter, a message of the second type that comprises, wherein the synthesized environmental measurement is a forged measurement that does not reflect and is not based on an actual physical measurement by a sensor, wherein the synthesized environmental measurement is obtained from the mapping based on the action and the current state, wherein said controller is configured to utilize the mapping to control the HVAC unit.

2. The controller of claim 1, wherein the HVAC unit is configured to utilize an iFeel feature, wherein the HVAC unit, when utilizing the iFeel feature, is configured to receive periodic messages from the dedicated remote control of the HVAC unit, wherein the periodic messages report sensed measurements that are obtained by a sensor on the dedicated remote control, wherein the periodic messages do not comprise a current state of the HVAC unit, wherein the HVAC unit is configured to act upon the sensed measurements, wherein said transmitter is configured to transmit messages comprising the synthesized environmental measurement to the HVAC unit to be processed as the periodic messages from the dedicated remote control.

3. The controller of claim 1, wherein the synthesized environmental measurement is a temperature measurement or a humidity measurement.

4. The controller of claim 1, wherein the mapping is determined as a reversed mapping of a second mapping, wherein the second mapping maps a pair of a state of the HVAC unit and a measurement to an action.

5. The controller of claim 1 further comprising one or more sensors, wherein said action determination module is configured to determine the action based on readings from the one or more sensors.

6. The controller of claim 1, wherein said action determination module is configured to determine the action based on a reading that is received from a sensor that is collocated with the HVAC unit.

7. The controller of claim 1 further comprising an HVAC state monitor configured to monitor an estimated state of the HVAC unit.

8. The controller of claim 1, wherein the HVAC unit is configured to utilize an iFeel feature, wherein the HVAC unit, when utilizing the iFeel feature, is configured to receive messages of the second type from the dedicated remote control of the HVAC unit reporting sensed measurements that are obtained by a sensor on the dedicated remote control and act upon the sensed measurements, wherein the message of the second type does not comprise the current state of the HVAC unit.

9. The controller of claim 1, wherein the HVAC unit is configured to utilize an iFeel feature, wherein the HVAC unit, when utilizing the iFeel feature, is configured to receive messages of the second type from the dedicated remote control of the HVAC unit, wherein the messages of the second type report sensed measurements that are obtained by a sensor on the dedicated remote control, wherein the HVAC unit is configured to act upon the sensed measurements.

10. The controller of claim 1, wherein the current state comprises a target measurement that the HVAC unit is set to attempt to reach, wherein the HVAC unit is configured, when receiving the synthesized environmental measurement to perform the action in order to attempt reach the target measurement.

11. A method performed by a computerized device that is configured to replace a dedicated remote control of an Heating Ventilation or Air-Conditioning (HVAC) unit, wherein the HVAC unit is configured to emit an audible operational sound when receiving a first type of messages, wherein the HVAC unit is configured to avoid emitting the audible operational sound when receiving a second type of messages, wherein each message of the second type comprises a reported measurement;

wherein said method comprising:

obtaining a current state of the HVAC unit;

obtaining an action to be taken by the HVAC unit;

instructing the HVAC unit to perform the action by transmitting a message of the second type that comprises a synthesized environmental measurement, wherein the synthesized environmental measurement is a forged measurement that does not reflect and is not based on an actual physical measurement by a sensor, wherein the synthesized environmental measurement is obtained from a mapping based on the action and the current state, wherein the mapping maps between pairs of a state of the HVAC unit and an action of the HVAC unit and between corresponding forged measurements; and transmitting the synthesized environmental measurement to the HVAC unit.

12. The method of claim 11, wherein the HVAC unit is configured to utilize an iFeel feature, wherein the HVAC unit, when utilizing the iFeel feature, is configured to receive periodic messages from the dedicated remote control of the HVAC unit, wherein the periodic messages report sensed measurements that are obtained by a sensor on the dedicated remote control, wherein the periodic messages do not comprise a current state of the HVAC unit, wherein the HVAC unit is configured to act upon the sensed measurements, wherein said transmitting is configured to transmit messages comprising the synthesized environmental measurement to the HVAC unit to be processed as the periodic messages from the dedicated remote control.

13. The method of claim 11, wherein the synthesized environmental measurement is a temperature measurement or a humidity measurement.

14. The method of claim 11, wherein the mapping is determined as a reversed mapping of a second mapping, wherein the second mapping maps a pair of a state of the HVAC unit and a measurement to an action.

15. The method of claim 11, wherein said determining the action comprises determining the action based on at least one reading by a sensor and based on the current state of the HVAC unit, wherein the sensor is external to the HVAC unit.

16. The method of claim 15, wherein the sensor is collocated with the HVAC unit.

17. The method of claim 11 further comprising using sensors to monitor the current state of the HVAC unit.

18. The method of claim 11, wherein the HVAC unit is configured to utilize an iFeel feature, wherein the HVAC unit, when utilizing the iFeel feature, is configured to receive messages of the second type from the dedicated remote control of the HVAC unit reporting sensed measurements that are obtained by a sensor on the dedicated remote control and act upon the sensed measurements, wherein the message of the second type does not comprise a current state of the HVAC unit.

19. The method of claim 11, wherein the HVAC unit is configured to utilize an iFeel feature, wherein the HVAC unit, when utilizing the iFeel feature, is configured to receive messages of the second type from the dedicated remote control of the HVAC unit, wherein the messages of the second type report sensed measurements that are obtained by a sensor on the dedicated remote control, wherein the HVAC unit is configured to act upon the sensed measurements.

20. The method of claim 11, wherein the current state comprises a target measurement that the HVAC unit is set to attempt to reach, wherein the HVAC unit is configured, when receiving the synthesized environmental measurement to perform the action in order to attempt reach the target measurement.

* * * * *